US006042333A

United States Patent [19]

Day

[11] Patent Number: 6,042,333

[45] Date of Patent: Mar. 28, 2000

[54] ADJUSTABLE PITCH IMPELLER

[75] Inventor: Terence Robert Day, Coombabah, Australia

[73] Assignee: Magiview Pty. Ltd., Queensland, Australia

[21] Appl. No.: 08/875,112

[22] PCT Filed: Jan. 3, 1996

[86] PCT No.: PCT/AU96/00001

§ 371 Date: Jul. 25, 1997

§ 102(e) Date: Jul. 25, 1997

[87] PCT Pub. No.: WO96/23140

PCT Pub. Date: Aug. 1, 1996

[30] Foreign Application Priority Data

| | | | |
|---|---|---|---|
| Jan. 25, 1995 | [AU] | Australia | PN0731 |
| Feb. 7, 1995 | [AU] | Australia | PN0941 |

[51] Int. Cl.[7] ..... F04D 29/36

[52] U.S. Cl. ..... 415/173.1; 416/165; 416/167; 416/174; 416/185; 416/188; 416/202; 416/244 R; 416/244 B

[58] Field of Search ..... 416/136, 165, 416/167, 168 R, 174, 185, 188, 189, 202, 205–209, 244 R, 244 B; 415/173.1

[56] References Cited

U.S. PATENT DOCUMENTS

| | | | |
|---|---|---|---|
| 822,064 | 5/1906 | Milham | 416/167 |
| 1,866,580 | 7/1932 | Schmitthenner | 416/168 R |
| 2,088,028 | 7/1937 | Mailander | 416/168 R |
| 2,434,896 | 1/1948 | Ayers | 416/188 |
| 2,953,208 | 9/1960 | O'Connor | 416/136 |
| 3,323,710 | 6/1967 | Ayers | 416/202 |
| 3,840,309 | 10/1974 | Eckes et al. | 416/165 |
| 3,904,314 | 9/1975 | Pedersen . | |
| 4,521,158 | 6/1985 | Fickelscher . | |
| 4,610,600 | 9/1986 | Bleier . | |
| 5,249,925 | 10/1993 | Guimbal et al. . | |

FOREIGN PATENT DOCUMENTS

| | | | |
|---|---|---|---|
| 94/11638 | 5/1994 | Australia . | |
| 1129253 | 1/1957 | France | 416/244 R |
| 338436 | 8/1920 | Germany | 416/188 |
| 447950 | 5/1936 | United Kingdom | 416/168 R |
| 1527530 | 11/1975 | United Kingdom . | |
| 2199378 | 12/1986 | United Kingdom . | |

OTHER PUBLICATIONS

Soviet Union Patent Abstract for Soviet Union Patent 453, 276 Dated Aug. 1982.

Japanese Patent Abstract for Japanese Patent 2–55,898, Dated Feb. 1990.

Japanese Patent Abstract for Japanese Patent 2–55,900 Dated Feb. 1990.

Japanese Patent Abstract for Japanese Patent 2–56,301 Dated Feb. 1990.

*Primary Examiner*—Christopher Verdier

*Attorney, Agent, or Firm*—Hoffman, Wasson & Gitler

[57] ABSTRACT

An impeller has a plurality of rotating passageways which can be defined between adjacent blades, the blades having a curved root portion and able to pivot across a part spherical hub to maintain a fine line contact. The passageways have a convergence to improve the efficiency of the impeller. The hub can be split into two relatively rotating portions, with the blades attached to each portion to provide an efficient means to vary the pitch of the blades.

10 Claims, 5 Drawing Sheets

ADJUSTABLE PITCH IMPELLER

TECHNICAL FIELD

This invention relates to an impeller and particularly relates to an improved impeller where the impeller hub has a spherical portion and where the impeller blades can be mounted to the hub in a manner which can improve the efficiency of the impeller. The invention also optionally includes an impeller having a split hub to allow the pitch of the impeller blades to be varied. The invention is applicable to impellers, but can also extend to other types of fan devices.

BACKGROUND ART

In certain applications of unducted and ducted fans and propellers, it is desirable to be able to adjust the pitch of the blades either between runs or during runs. This can be done by manual adjustment, or by allowing the blades to self-adjust during operation.

Adjustment of fan or propeller blade pitch is known in the case of ordinary unducted fans and especially propellers. The mechanisms used to adjust the pitch are adequate as the propellers or fans are simply air movers and do not produce any significant pressure on the discharge side.

Many ducted fans are required to produce some form of head pressure, even in an axial situation where air travels between the blades in a path which is substantially parallel to the axis of rotation of the fan. An example of this is an axial flow compressor section of a gas turbine engine. These types of axial fans produce only small head pressures and to increase the pressure, need to be multi-staged. Radial or centrifugal fans produce a greater degree of head pressure than axial flow fans.

In my earlier impeller which is described in International patent application PCT/AU93/00581, I provided a pressure-boost impeller which had overlapping blades attached to a hub which could be of a frusto-conical shape. The blades were inclined relative to the rotational axis which produced a large throat area to reduce stall during rotation. The impeller could be used as an axial flow impeller while still producing appreciable head pressure and this was achieved by convergence between adjacent blades.

In use, my earlier impeller sat within a housing with the tips of the blades sweeping closely along the inner wall of the housing. The roots of the blades could be pivotally mounted to the hub to allow the pitch of the blade to be adjusted. Adjustability of the blades was desirable to maintain high efficiency. Because the hub could be curved in only one direction, rotating the blade to adjust its pitch, created a small but unwanted gap between the blade root and the surface of the hub and between the blade tip and the inner wall of the shroud. This small gap allowed fluid to pass back through the impeller, which reduced its efficiency.

As my impeller can be rotated at high speed, it is desirable to be able to mount the blades to the hub in an adjustable manner but in such a fashion that the blades do not break or separate from the hub due to inertial forces.

Australian patent 210289 discloses a radial flow impeller which can pressurise a gas by the standard technique of increasing the speed of the gas followed by a sudden change in the speed of the gas. The impeller includes a number of non-overlapping blades which are attached to a hub via a journalled disc. The hub has an annular portion which is curved in two directions and can be seen as being a portion of a sphere. The stated advantage is that this allows the blades to be twisted without creating a gap between the blade tip and housing or the blade root and hub. The top face of the disc is flat which does not present a problem with the fan of patent 210289; and indeed the patent does not offer any further teaching on this point.

Axial flow and mixed flow fans have a central hub portion containing the axis of rotation, and a number of blades attached to the central hub portion. In order to improve the efficiency of the fan, or vary its operating parameters, the pitch of the blades can be varied. This is typically achieved by having the blades mounted to the hub in such a manner to allow the blades to rotate or twist relative to the hub. Various complicated internal mechanisms are provided to allow the pitch of the blade to be varied.

A disadvantage with known arrangements is that for fans or impellers having a large number of blades, the internal mechanism is extremely complicated, while for fans and impellers having a relatively smaller diameter, and therefore a small hub portion, it is generally not possible to provide a robust and reliable mechanism to vary the pitch of the blades.

In international patent application PCT/AU93/00581, there is disclosed a pressure boost impeller having blades which are pivotally mounted to the hub. These blades can pivot freely and at high speed rotation of the impeller, blade flutter or other undesirable vibrations can occur. The international patent application does not describe any mechanism by which the pitch of the blades can be varied and held in position.

The present invention, in one form, has been developed to provide an impeller where the blades can be pivoted on the hub without resulting in undue gaps appearing between the blade and hub. The present invention can optionally include a simple and reliable system whereby the pitch of a plurality of blades mounted to a central hub portion can be varied and held in position.

DISCLOSURE OF THE INVENTION

In one form the invention resides in an impeller having a hub and a plurality of blades attached to the hub, the hub having a front face, and a rear face, and a part spherical portion between the front and rear faces, the blades having a root portion and a tip portion, the root portion being complementarily configured to the spherical portion, the blades being attached to the hub on the spherical portion, with adjacent blades defining a passageway therebetween, the passageway having a fluid inlet and a fluid outlet, the passageway converging between the inlet and the outlet.

Throughout the description and claims, the term blades is used in a non-limiting sense. The function of the blades is to define the walls of the passageway through which the fluid passes. Thus it appears that other types of walls will also be suitable and which may not fall precisely within the term blades. The invention can be seen as a number of rotating passageways where the blades are just one preferred type of wall to define the passageway. For convenience however, the term blades will be used through the description and claims.

By having the blades on the spherical portion, and having the root of each blade of a configuration complementary to the shape of the spherical portion, the blades can be pivoted without producing an appreciable gap, or altering the gap at any point.

The spherical portion produces curved surfaces in two directions which are at right-angles to each other. The curvature of the spherical portion is preferably such that the radius of the curve is the same in both of the directions.

The hub may have a flattened front nose portion, and the spherical portion may extend adjacent the nose portion. The rear of the hub may be substantially planar.

The blades may be attached to the hub by providing the blades with pins which can extend into recesses on the hub. The recesses may be equally spaced about the hub and in the spherical portion.

To improve control over rotation of the blades, the pins may extend from adjacent a leading edge of the blade such that the blade is attached to the hub at a forward portion of the blade or up to a mid chord point of the blade. The recesses may therefore be adjacent an upper part of the spherical portion which allows the recesses to extend through a thicker more stronger portion of the hub.

To strengthen the attachment of the blades to the hub, the pins may include or comprise a collar portion which can extend at least partially into the recess. A shoulder may be provided which can again strengthen the attachment between a blade and the hub. The shoulder may have an upper face which is flush with the spherical portion, and this upper face may be curved in two directions to allow the blade to pivot without having undue gaps occurring.

Adjacent blades may be attached to the hub and may be in a spaced overlapping relationship relative to each other. The spacing between the blades adjacent their trailing edges may be less than the leading edges to produce the convergence and which can prevent fluid exiting the trailing edges from creeping back into the passageway defined by adjacent blades, or in an adjacent passageway. Alternatively, the passageway defined between adjacent blades may converge between the inlet and outlet either throughout its entire length or a portion thereof.

In another form, the invention resides in an impeller having a hub and a plurality of blades attached to the hub, at least some of the blades having pins which extend into recesses on the hub, the blades also having an extending land portion over which the root portion of an adjacent blade can pass to resist removal of the blade from the recess.

Suitably, the blades have a plate like or disc like land portion which can pass into a respective recess such that an upper face of the land portion is substantially flush with the surface of the hub. Alternatively, the land portion may be proud of the recess and this may require the root portion of the adjacent blade to be profiled to allow it to pass over the land portion without striking it.

The above described arrangement can allow the blades to be rotated or positioned such that the root portion of one blade at least partially overlies the land portion of an adjacent blade so that if a blade becomes loose, it will be restrained by the adjacent blade against being flung off or torn away from the hub, especially if the hub is rotating at high speed.

Suitably, the impeller has a leading hub portion and a trailing hub portion which are movable relative to each other, and a plurality of blades, at least some of the blades being pivotally attached to the leading hub portion, and also attached the trailing hub portion such that relative movement of the hub portions causes the pitch of the blades to vary.

By having the hub formed from the two hub I portions which can rotate relative to each other, and by having the blades pivotally attached to one of the hub portions, and slidably attached to the other hub portion, a simple yet effective mechanism to vary the pitch of the blades is provided. Preferably, the blades are pivotally attached to the leading hub portion and slidably attached to the trailing hub portion. The hub may have a substantially planar front face and rear face and a side wall extending between the front face and the rear face. The front face may comprise a forward portion of the leading hub portion, and the rear face may comprise a rear portion of the trailing hub portion.

An axis of rotation may extend through the hub, and the hub may be attached to a rotatable shaft.

If the hub is formed from two hub portions, the hub may be curved in one or two directions. In one embodiment, the side wall is curved in one direction extending about the rotation axis to define a hub which can be substantially cylindrical or cone-like in configuration. In another embodiment, the side wall of the hub may be curved in two directions which may be at right angles to each other to define a part spherical surface.

The side wall of the hub can be made up of the side wall of the leading hub portion and the side wall of the trailing hub portion. It is preferred that the shape of the side wall is continuous between the leading hub portion and the trailing hub portion. For instance, if the side wall of the entire hub is part spherical in configuration, it is preferred that the part spherical configuration is carried over from the leading hub portion to the trailing hub portion.

The leading hub portion may comprise a major part of the hub, and also a major part of the side wall of the combined hub portions. For instance, between 50% to 90% of the surface area of the combined hub may be defined by the leading hub portion with the remainder being defined by the trailing hub portion.

While the leading hub portion and the trailing hub portion are moveable relative to each other, it is I preferred that the leading hub portion is fixed to the shaft of the impeller, and that the trailing hub portion is moveable or adjustable relative to the leading hub portion.

The leading hub portion and the trailing hub portion may be joined together such that the rear wall of the leading hub portion abuts against or is closely spaced from the front wall of the trailing hub portion, while still allowing the two hub portions to move relative to each other.

A guide means may be provided to assist in the relative movement of the two hub portions together. In one form, the guide means may comprise a projection on one of the hub portions which locates within a recess on the other of the hub portions, the construction and arrangement being such that the two hub portions can still move relative to each other. In an embodiment, the projection may comprise an annular rib which locates within an annular recess. This can assist in adjustment of the two hub portions relative to each other.

A locking means may be provided to lock the two hub portions together when in the desired position. The lock means may comprise a releasable lock means and in a simple form, this can comprise a locking bolt or other type of fastener.

While the two hub portions may be adjusted manually, in many instances the impeller may be located within a housing or shroud and therefore generally inaccessible. For this reason, adjustment of the hub portions may also be made without requiring removal of the impeller from its housing. While there may be several actuating means which may be able to adjust the two hub portions relative to each other, a preferred actuating means is one whereby the hub portions can be adjusted relative to each other by a remote actuating means.

There is no requirement to manually adjust the hub portions, or to use an actuating means. In a simple form, the hub portions can be free to move relative to each other so that the pitch of the blades will be set according to the operating conditions of the impeller such as head pressure or the type of fluid. In this simple "free wheeling" alternative, the linking of the blades to both hub portions will minimise uneven forces or loads being applied to the impeller in use.

The impeller includes a number of blades. The blades may have a leading portion attached to the leading hub portion, and a trailing portion attached to the trailing hub portion. The leading portion of the blade may have a pin which extends into an opening on the side wall of the leading hub portion, the pin being attached to the hub portion such that the blade can pivot or rotate in the opening, but cannot be removed from the opening.

The trailing portion of the blade may also include a pin which can extend into a slot on the trailing hub portion, the slot being angled such that relative movement of the two hub portions causes pivoting of the leading blade portion, and sliding movement of the pin on the trailing blade portion along the slot on the trailing hub portion.

BRIEF DESCRIPTION OF THE DRAWINGS

Embodiment of the invention will be described with reference to the following drawings in which.

BEST MODE

Figure 1:
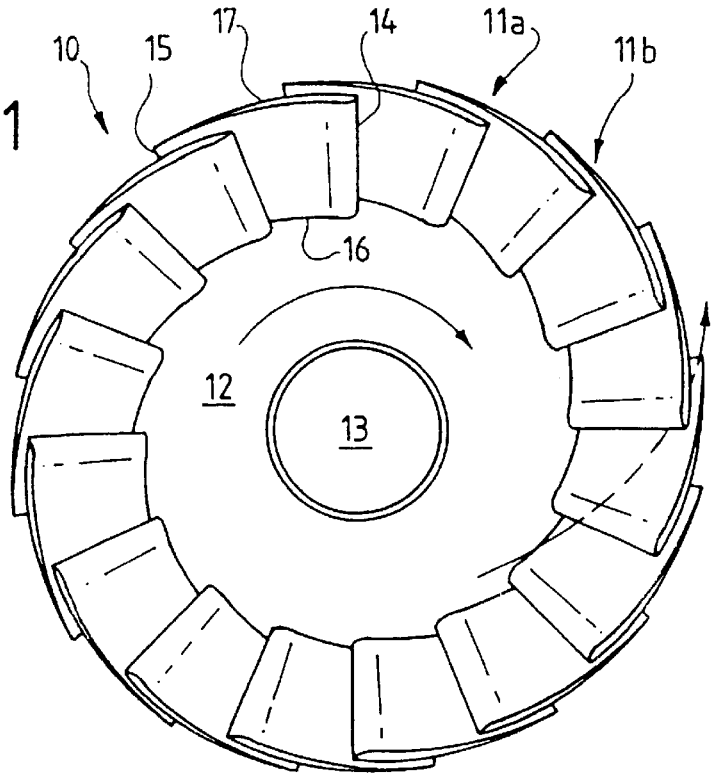
FIG. 1 is a simple plan view of an impeller according to an embodiment of the invention.

Referring to FIG. 1, there is illustrated an impeller 10. Impeller 10 comprises a plurality of blades 11*a*, 11*b*, etc., which extend about a hub 12. Hub 12 has a central axis of rotation 30 which is a bore passing through the hub so that the impeller can be press-fitted or otherwise mounted to a shaft. Each blade has a leading edge 14 and a trailing edge 15, a root portion 16 and a tip portion 17.

Figure 2:
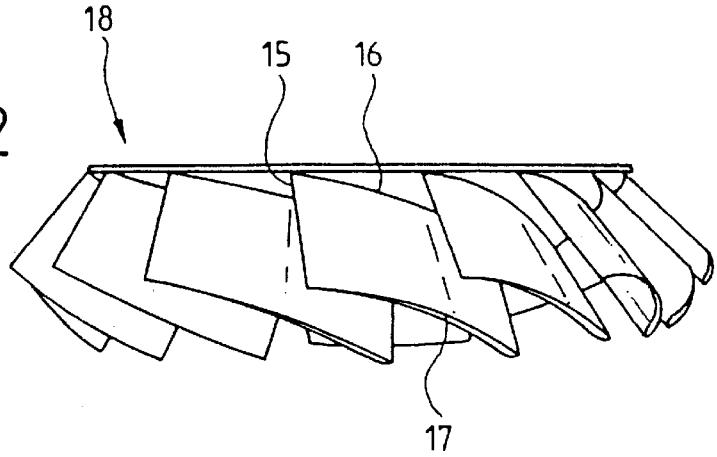
FIG. 2 is a side view of the impeller of FIG. 1.
Figure 3:
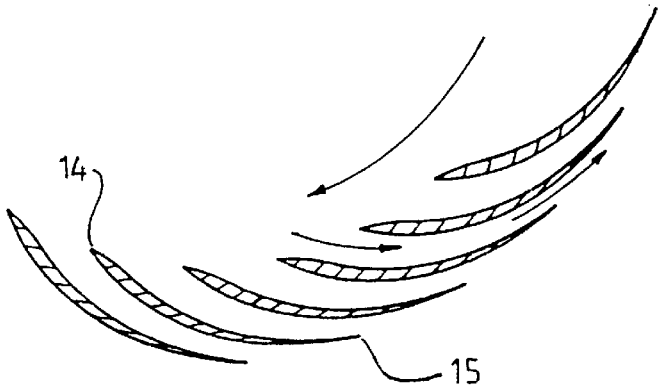
FIG. 3 is a cross sectional view illustrating convergence between adjacent blades.

As shown in FIGS. 1–3, adjacent blades overlap each other such that when the impeller is caused to rotate, fluid passes between adjacent blades. The area between adjacent blades can be seen as a passageway through which the fluid passes. Each blade can have a thickened leading nose portion (see FIGS. 3 and 4) which functions to sweep fluid into the passageway defined between adjacent blades, and to reduce turbulence. However this may not be essential, and the leading edge can also be sharp. The impeller has a rear discharge area 18 which can be substantially flat. As fluid enters the passageway it is compressed by virtue of it impacting against the surface of a rotating blade. The convergence of the tail end of the passageway is tuned to approximate the "thickness" of the compressed layer of fluid so that areas of lower pressure are minimised as the fluid moves out of the passageway. It is thought that this minimises back flow of fluid or fluid moving around the tail edge of a blade from one passageway to the adjacent passageway. The convergence need not be at the tail end and can be some distance within the passageway.

Figure 4:
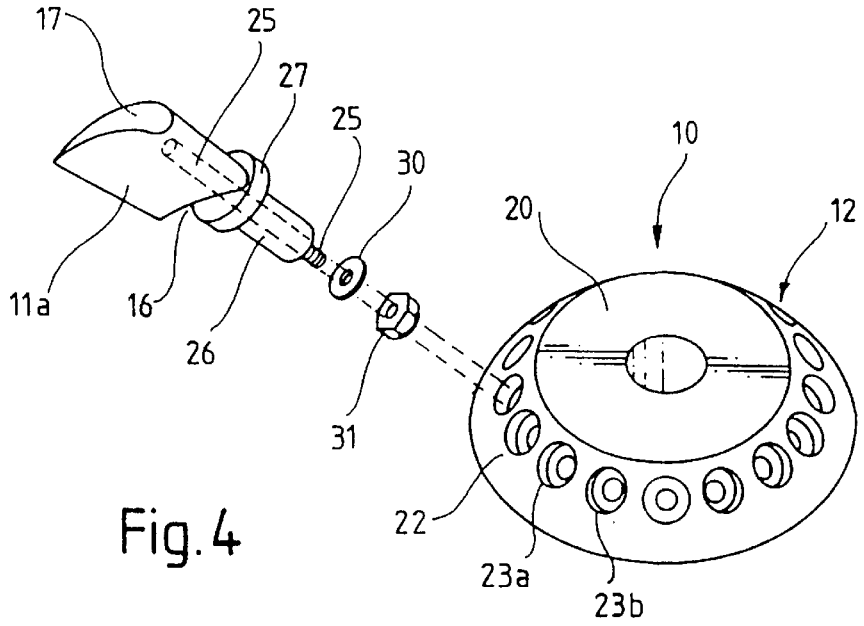
FIG. 4 is an exploded view showing the attachment of a blade to the impeller hub.

FIG. 4 shows an exploded view of the impeller with one blade. As shown in FIG. 4, impeller 10 has a flat forward nose portion 20 on which a nose cone 21 (see FIG. 5) is attached during use. Adjacent nose portion 20 is a spherical portion 22.

Spaced about spherical portion 22 are a number of equally spaced circular recesses 23*a*, 23*b*, etc. The recesses have an initial larger opening followed by an internal step which then passes to a smaller circular opening. Each recess is positioned in an upper part of annular portion 22, that is more towards the flat nose portion 20.

A blade 11*a* can be pivotally mounted or fixed to hub 12. Blade 11*a* is provided with a pin 25 which extends through the blade and also extends downwardly from the root portion 16. Pin 25 could alternatively be integrally formed with the blade 11*a*. The pin extends from a leading portion of the blade as shown in FIG. 4, that is, the pin does not extend from a central portion of the blade. This allows the blade to pivot from its front area as opposed to its central area. Around pin 25 is provided a collar 26 and above collar 26 is an annular shoulder or disc 27.

Figure 5:
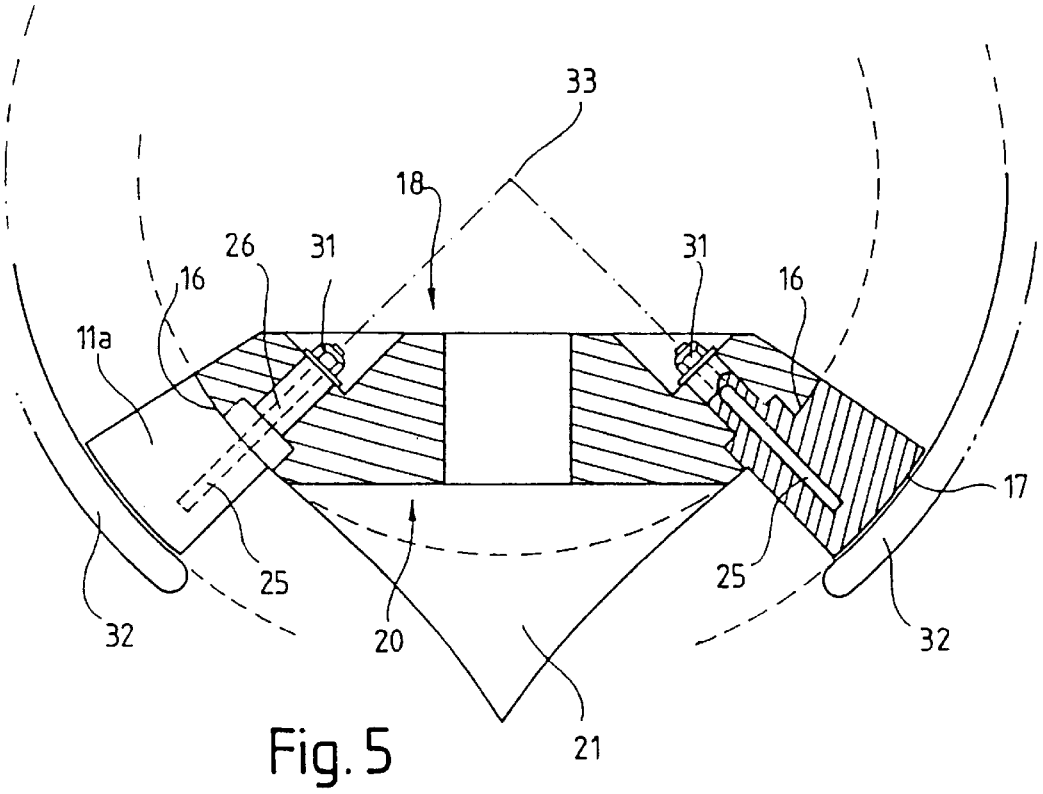
FIG. 5 is a section view showing the attachment of two blades to the hub and where the hub is within a housing or shroud.

It can be seen that shoulder 27 fits neatly within the initial larger opening of a respective recess (e.g., 23*a*), while collar 26 fits neatly into the second smaller circular opening in the recess. The bottom of shoulder 27 sits against a top wall of the internal step in a particular recess (e.g., 23*a*). This arrangement provides a good strong securement of the blade to the hub and minimises the blade being torn away from the hub upon high-speed rotation. A washer 30 and a lock-nut 31 are provided to fasten the blade to the hub. FIG. 5 illustrates the method of attachment of two blades to the hub.

The root portion 16 of each blade is curved to complement the shape of spherical portion 22. Thus, pivoting of a particular blade results in root portion 16 having a fine-line spacing with spherical portion 22 irrespective of the pivoting angle. Also, by having recesses 23*a*, 23*b* in an upper part of spherical portion 22, the recesses extend through a thicker stronger part of the hub which can be seen in FIG. 5.

The blades are prevented from twisting or pivoting through 360° as they will abut an adjacent blade before this occurs. However, in the area where the blades do pivot, root portion 16 maintains a fine-line spacing with spherical portion 22.

As the blades are close together, and especially if the impeller is a small diameter impeller, rotation of the blades can cause the root portion 16 of one blade to sweep over the top wall of shoulder 27. This top wall is also spherical in shape and identical to the shape of spherical portion 22 so that should a blade sweep over this portion, it will still retain a fine line spacing with the top wall of the shoulder thereby minimising gap formation.

The impeller can be designed to ensure that one blade overlaps the top wall of the shoulder portion of an adjacent blade. Thus, should a blade become loose during high speed rotation, it will be held in place by the adjacent blade and will not be flung or torn away from the hub.

FIG. 5 shows a housing or shroud 32 in which the impeller rotates. Shroud 32 has an internal spherical wall and the tip 17 of the blades are curved such that they too retain a fine-line spacing with minimal gap between the tip and the internal wall of shroud 32 irrespective of how the blade is pivoted. To achieve this, and as illustrated in FIG. 5, the longitudinal axis of pins 25 of each blade are aligned to the hypothetical dead-centre 33 of a sphere of which spherical portion 22 forms part of the surface. If this configuration is maintained, the blades can be pivoted on spherical portion 22 and within shroud 32 without gaps occurring.

Figure 6:
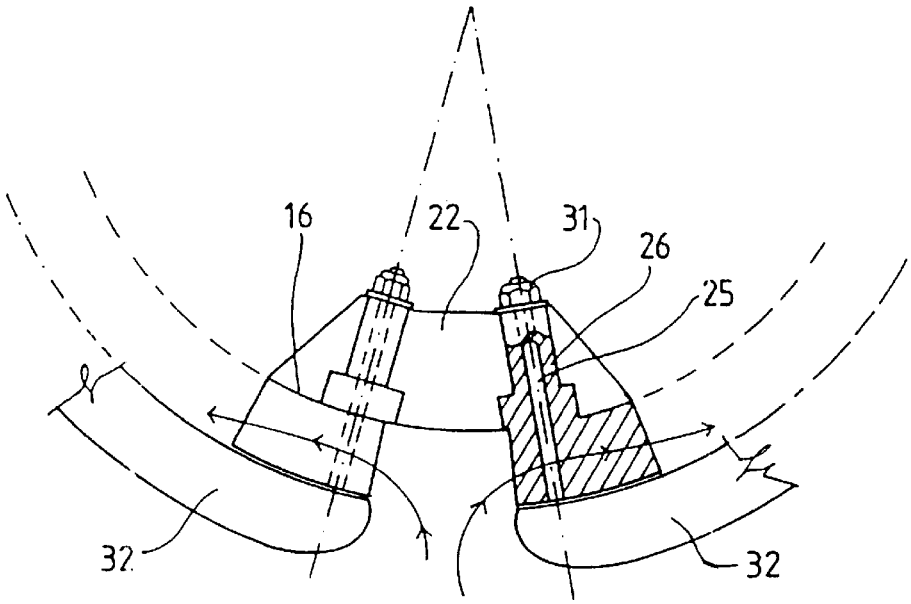
FIG. 6 shows an attachment arrangement of the blades on the hub, where the blades are at a different angle.
Figure 7:
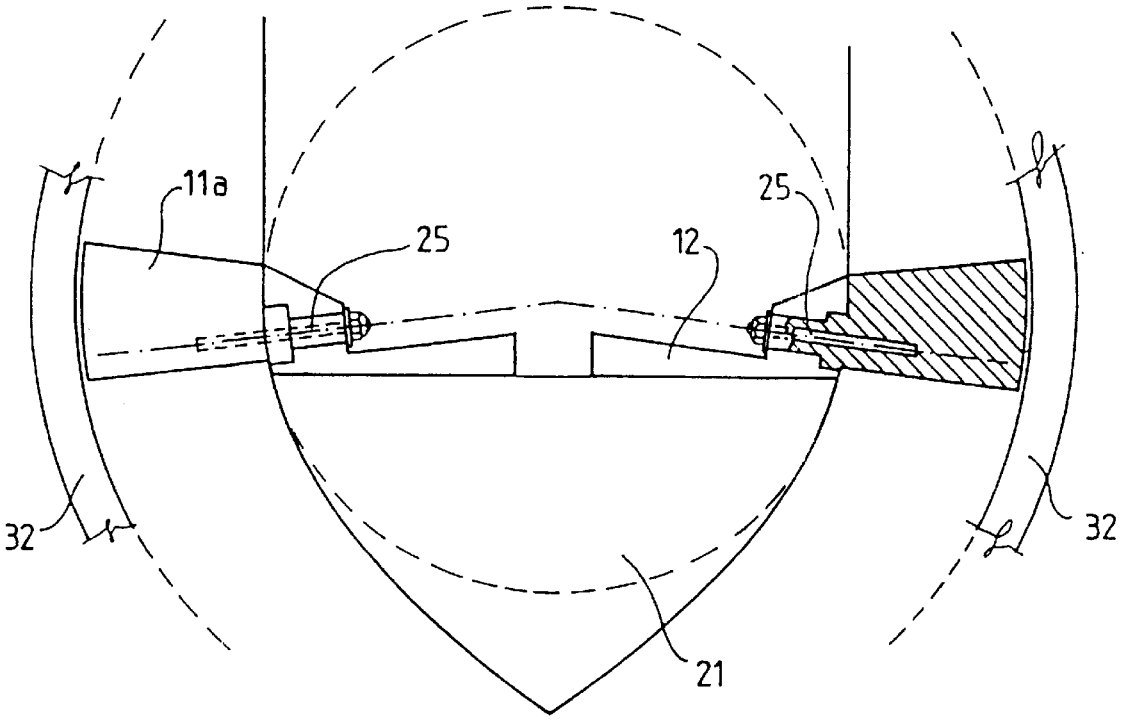
FIG. 7 shows a further alternative attachment arrangement of the blades on the hub.

FIGS. 6 and 7 show variations to the impeller but in each instance, the principles of the impeller are the same and like numbers have been used to refer to like components.

Figure 8:
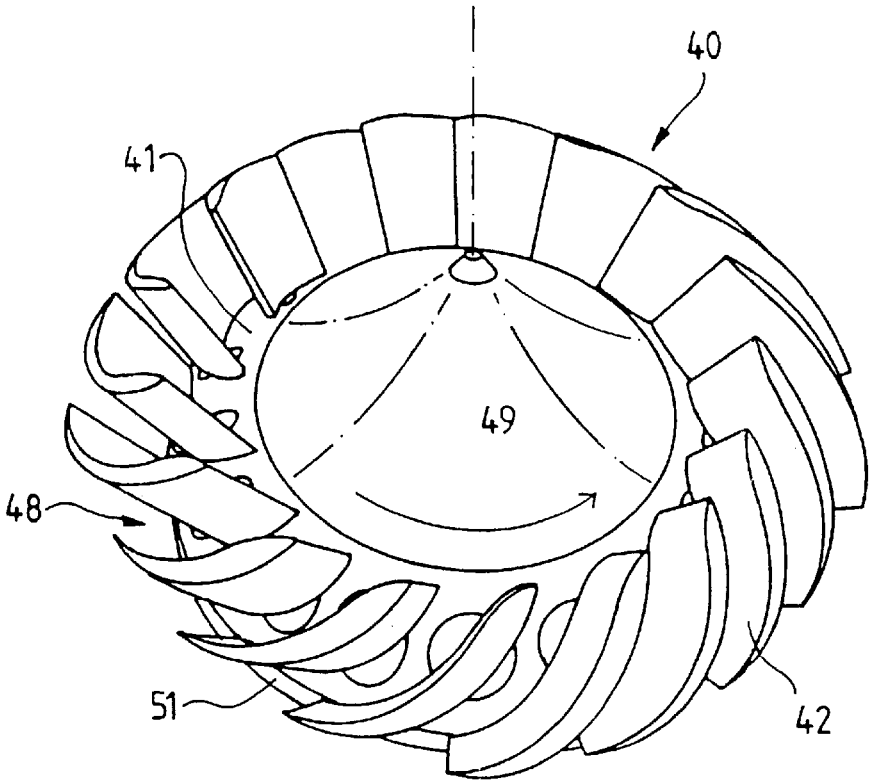
FIG. 8 is a view of an impeller having a split hub.

Referring to FIG. 8 there is shown an impeller 40. Impeller 40 can be formed from metal (although it need not be limited to such) and comprises a central hub 41 and a plurality of blades 42. Each blade 42 has a leading edge 43, a trailing edge 44, a tip 45 and a root 46 (better illustrated in FIGS. 9 and 12). Impeller 40 has an intake area which is defined by the junction of a leading edge 43 and a tip 45 of a particular blade 42. The impeller has a discharge area defined between the trailing edges 44 of the blades 42. Hub 41 has a central bore 47 so that the impeller can be press fitted to a shaft for rotation with the shaft.

The impeller blades are in an at least partially overlapping relationship to define a passageway 48 between adjacent blades. The adjacent blades can have an overlap area of between 30% to 70% to ensure the existence of a reasonably sized passageway 48. The blades diverge outwardly relative to the rotation axis as shown in FIG. 8 which results in the formation of a large intake area. Each blade can have a thickened leading nose portion which functions to sweep fluid into the passageway 48. As fluid enters into the passageway it is compressed by virtue of it impacting against the surface of a rotating blade. Adjacent blades can converge such that the spacing between adjacent blades at the discharge end is less than the spacing between the blades at the intake end. The convergence or spacing is tuned to approximate the "thickness" of the compressed layer of fluid passing through the passageway so that areas of lower pressure are minimised as the fluid moves out of the passageway. It is thought that this minimises backflow of fluid or fluid moving around the tail edge of a blade from one passageway to the adjacent passageway. The convergence need not be at the tail end and can also be some distance within the passageway, and it should be appreciated that the invention resides in the split hub arrangement and not necessarily in the type of blades attached to the hub.

A nose cone 49 can be attached to hub 41 to pass fluid such as air or water into the passageway 48 defined between adjacent blades.

Figure 9:
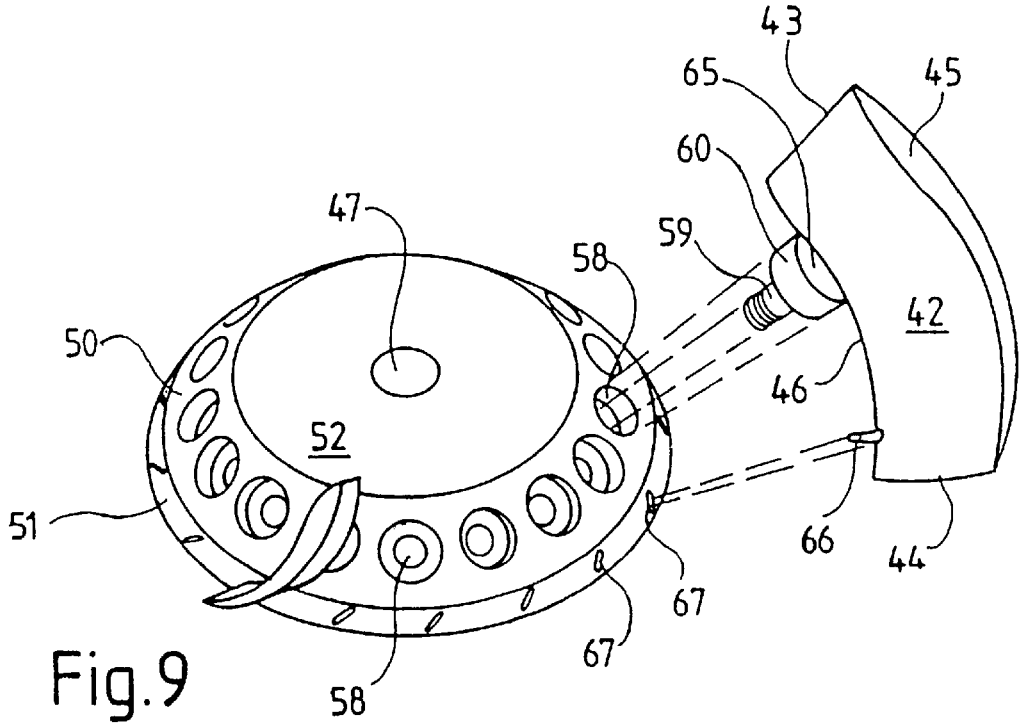
FIG. 9 is a part assembled view of the impeller of FIG. 8.
Figure 10:
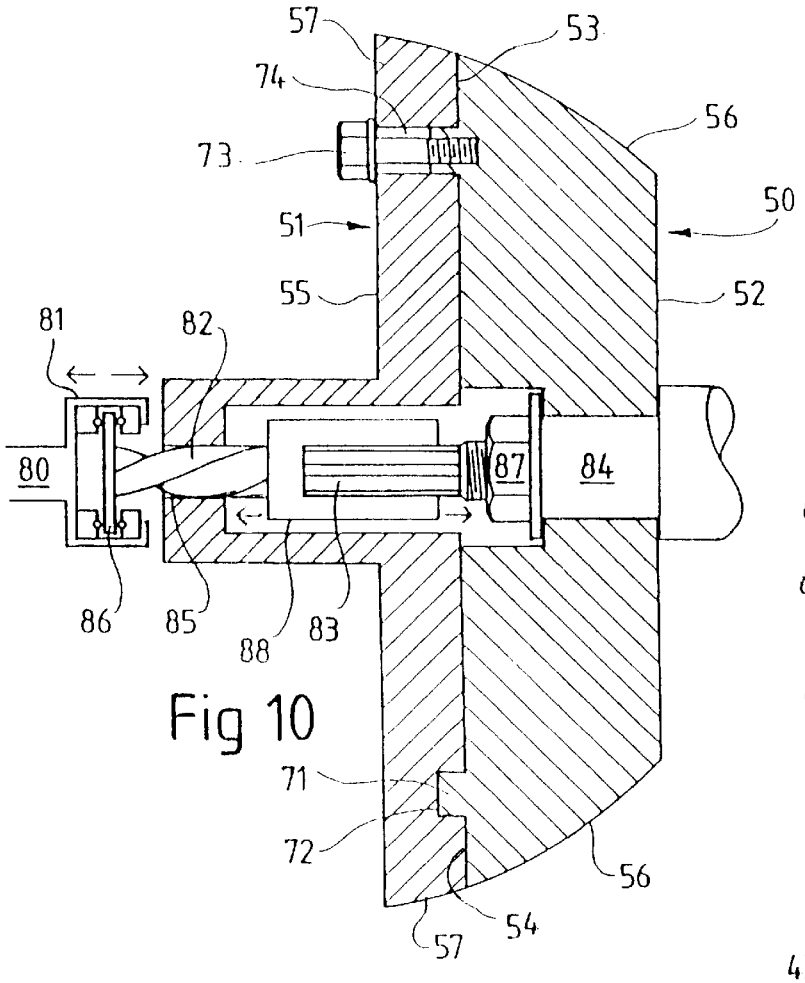
FIG. 10 is a side section view of the impeller of FIG. 8.

Hub 41 is formed from two hub portions being a leading hub portion 50 and a trailing hub portion 51 which are more clearly illustrated in FIGS. 9 and 10. Leading hub portion 50 has a substantially planar front face 52 over which nose cone 49 can be attached, and also has a substantially flat rear face 53 which is illustrated in FIG. 10. Trailing hub portion 51 also has a flat front face 54 (see FIG. 10) and a substantially flat rear face 55. Leading hub portion 50 has a side wall 56 and trailing hub portion 51 also has a side wall 57. Side walls 56 and 57, in the embodiment, are curved in two directions at right angles to each other to form a part spherical surface. Furthermore, side walls 56 and 57 are continuous such that the combined side walls are also part spherical in configuration.

Spaced about leading hub portion 50 are a number of equally spaced circular recesses 58 (see FIG. 9). These recesses have an initial larger circular opening followed by an internal step which then passes into a smaller circular opening. A particular blade 42 can be pivotally mounted to leading hub portion 50. Blade 42 is provided with a pin 59 which extends downwardly from root 46 of the blade. The pin 59 extends from a forward portion of blade 42, that is, between leading edge 43 and a midsection of the blade. Around pin 59 is a collar 60 of larger diameter and it can be seen that collar 60 fits neatly within the initial larger opening of a respective recess 58 while pin 59 fits neatly into the second smaller opening in recess 58. This arrangement provides a good strong securement of the blade to the hub and minimises the blade being torn away from the hub upon high speed rotation. A lock nut 61 (see FIG. 11), or a circlip 62 (see FIG. 12), or other types of fastening means can be provided to secure the blades within recesses 58 while still allowing the blades to rotate in their respective recesses 58. Under conditions of high load, the pins may pass through bearings, such as ball bearings, roller bearings or needle bearings of some kind.

The root 46 of each blade is curved to compliment the shape of the spherical hub portion. Thus, pivoting of a particular blade in recess 58 results in root 46 having a fine line spacing with the spherical hub portion irrespective of the pivoting angle. The blades are prevented from pivoting through 360° as they will abut against an adjacent blade before this occurs. However, in the area where the blades do pivot, root 46 maintains a fine line spacing with the spherical hub portion. As the blades are close together, and especially if the impeller is a small diameter impeller, pivoting of the blades in recess 58 can cause root 46 of one blade to sweep over the top wall 65 of collar 60 of an adjacent blade. This top wall 65 is also spherical in shape and identical to the shape of the spherical hub portion so that should a blade sweep over top wall 65, it will still retain a fine line spacing, thereby minimising gap formation.

The impeller can be designed to ensure that one blade overlaps the top wall 65 of collar 60 of an adjacent blade. Thus, should a blade become loose during high speed rotation, it will be held in place by the adjacent blade and will not be flung or torn away from the hub.

Figure 12:
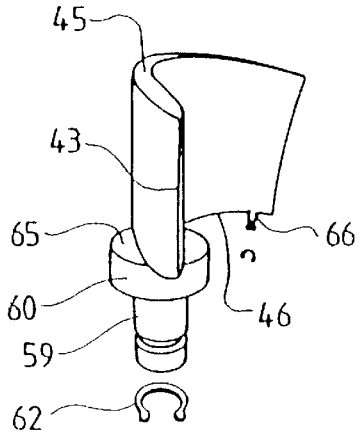
FIG. 12 is a blade according to an embodiment of the invention.
Figure 11:
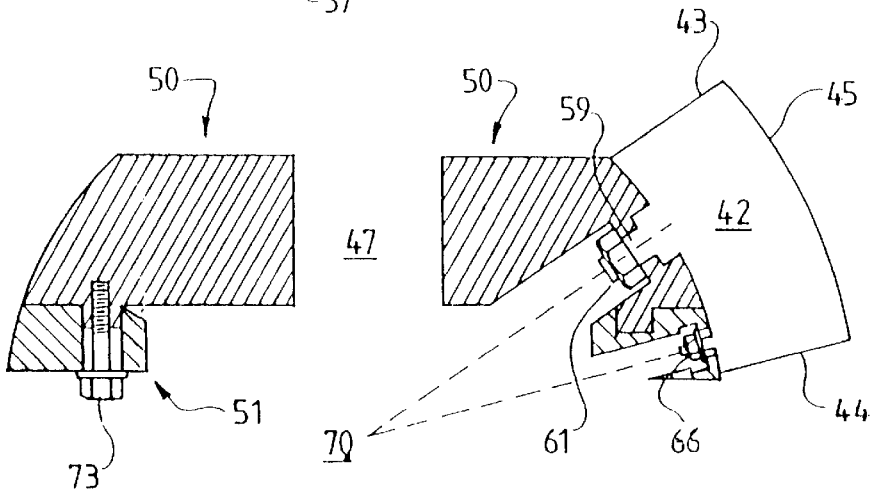
FIG. 11 is a section view showing a method of attachment of a blade to the hub.

Each blade 42 has a second pin 66 extending from root 46 and being adjacent trailing edge 44 of the blade. Pin 66 extends into a slot 67, slot 67 being in trailing hub portion 51. Pin 66 locates within slot 67 and a circlip as shown in FIG. 12, or a locking nut as shown in FIG. 11 can be used to secure pin 66 in slot 67 while still allowing the pin to move along the slot. Slot 67 extends at an angle to the axis of rotation and the longitudinal axis of a particular slot is directed towards a corresponding recess 58. Pin 66 can have the same configuration as pin 59, that is, it can also have a collar having a top wall which is part spherical in shape, and slot 67 can be configured to accept the collar in a manner similar to that of pin 59.

It can be seen from FIG. 9 and FIG. 11 that blade 42 can be pivotally attached to leading hub portion 50 by virtue of pin 59 extending through a corresponding recess 58 and being locked therein against removal but still allowing pivoting of the blade. The rear portion of blade 42 is attached to trailing hub portion 51 by virtue of pin 66 extending into slot 67.

Relative rotation of trailing hub portion to leading hub portion will cause all of the blades 42 to pivot in their respective recesses 58, and will cause pins 66 to ride along their corresponding slots 67. To minimise any gap formation between root 46 and the spherical portion of the hub, the longitudinal axis of pins 59 and 66 should be directed to the dead centre of a sphere, part of which is defined by spherical hub portions 50 and 51. FIG. 11 illustrates this arrangement with the hypothetical centre being given as reference 70. If this configuration is maintained the blades can be moved on the spherical hub portion and within the spherical shroud without gaps occurring.

Leading hub portion 50 and trailing hub portion 51 can be mated together as shown in FIG. 10, and a guide means can be used to assist in relative rotation of the two hub portions. In the embodiment, the guide means comprises an annular bead 71 extending from the rear face of leading hub portion 50, the bead locating within an annular recess 72 in the front face of trailing hub portion 51. Bead 71 and recess 72 are dimensioned to be a snug fit while still allowing the two hub portions to rotate relative to each other. A locking means in the form of a threaded bolt 73 can be used to lock leading hub portion 50 and trailing hub portion 51 together once the desired relative movement has been achieved. Bolt 73 can be removed or loosened to allow the movement to occur. Bolt 73 has a threaded portion which extends into a threaded recess on bead 71 (see FIG. 10), and trailing hub portion 51 may be provided with an arcuate slot 74 such that bolt 73 need only be loosened and moved along slot 74 and then retightened to clamp the two hub portions together. It should be appreciated that this is only a preferred type of locking means.

In order to allow the two hub portions to be rotated relative to each other without having to remove the impeller or partially dismantle an assembly containing the impeller, a hub actuating means may be provided to allow the relative rotation between the two hub portions to be made more easily. A preferred form of hub actuating means is illustrated in FIG. 10.

In FIG. 10, there is illustrated a pusher rod 80. At the end of rod 80, is provided a bearing housing 81 which holds one end of a twist shaft 82. Twist shaft 82 is operatively attached to a splined shaft 83. Splined shaft 83 is, or forms part of, a front drive shaft 84 which drives the impeller.

Pusher rod 80 can be moved towards and away from housing 85, and in doing so causes twist shaft 82 to move in and out from housing 85. Twist shaft 82 is attached to disk 86 which can freely rotate in bearing housing 81 upon rotation of front drive shaft 84. Housing 85 has an internal bore through which twist shaft 82 passes, the internal bore also having a twist therein such that when pusher rod 80 pushes twist shaft into housing 85, housing 85 is caused to rotate, which in turn rotates the entire trailing hub portion 51. Leading hub portion 50 is firmly locked to drive shaft 84 through locking bolt 87. The linear movement of twist shaft 82 is accommodated by splined shaft 83 which has a number of longitudinal splines which locate within a number of longitudinal splined recesses in housing 88. Thus, rotation of front drive 2 shaft 84 causes twist shaft 82 to rotate and splined shaft 83 accommodates the reciprocal movement of twist shaft 82. In use, the pitch of the blades attached to both leading hub portion 50 and trailing hub portion 51 can be varied by moving pusher rod 80 which in turn moves twist shaft 82 which in turn causes trailing hub portion 51 to move relative to fixed leading hub portion 50. Of course, it will be necessary to initially loosen bolt 73. All the blades 42 on the impeller will be rotated by the same amount and will be held in that position as long as pusher rod 80 is held in its position.

The invention allows fans to have a variety of adjustments and where the blade pitch can be adjustable without substantially altering blade clearances at the root or the tip. Even extreme blade flex will not be able to cause blade contact with the shroud.

As shown in the embodiments, apart from the portion where the blades are attached, the remainder of the hub does not need to possess spherical or concave walls.

It should be appreciated that various other changes and modifications may be made to the embodiments described without departing from the spirit and scope of the invention.

I claim:

1. An impeller having a hub and a plurality of blades attached to the hub, comprising the hub having a front face and a rear face, and a part spherical portion between the front and rear faces, the blades having a root portion and a tip portion, the root portion being complementarily configured to the spherical portion, the blades being attached to the hub on the spherical portion by pins extending from the blades at a position between a leading edge of the blades up to a mid chord point of the blades and which extend into recesses in an upper part of the hub, the extending pins having a shoulder to strengthen the attachment of the blades to the hub, the shoulder having an upper face which is flush with the spherical portion of the hub, the upper face having a part spherical configuration to compliment the hub such that the blades can pivot without the formation of undue gaps between the root portion of the blades and the hub, and the root portion of each blade extends at least partially over the upper face of the shoulder of an adjacent blade to restrain the blades from tearing away from the hub during high speed rotation, and adjacent blades define a passageway therebetween, the passageway converging between a fluid inlet and a fluid outlet, the blades are in a spaced overlapping relationship relative to each other to define part of the passageways, and the spacings between adjacent blades adjacent trailing edges of the blades are less than the spacings between adjacent blades at the leading edges to provide the converging passageways.

2. The impeller of claim 1, which includes a control means which is attached to at least some blades and which is operable to cause a pitch of all the attached blades to vary by the same amount.

3. The impeller of claim 2, wherein the all blades are attached to the control means.

4. The impeller of claim 2, wherein the control means and the hub can move freely relative to each other such that the pitch of the blades can vary during operation of the impeller.

5. The impeller of claim 2, wherein the hub has a leading hub portion and a trailing hub portion which are movable relative to each other, the trailing hub portion includes the control means and at least some of the blades being pivotally attached to the leading hub portion such that relative movement of the hub portions causes the pitch of the blades to vary.

6. The impeller of claim 5, wherein the blades are slidably attached to the trailing hub portion.

7. The impeller of claim 6, wherein the leading hub portion is fixed to an impeller shaft and the trailing hub portion is rotatably adjustable relative to the leading hub portion.

8. The impeller of claim 6, wherein each blade has a leading portion, a pin extending from the leading portion which extends into a recess in the leading hub portion, a trailing portion, and a pin extending from the trailing portion which slides along a slot in the trailing hub portion, the slot being angled relative to the axis of rotation.

9. The impeller of clam 5 wherein the impeller rotates within a shroud which has an at least partially spherical inner wall, the blades each having a curved tip which are shaped to allow the blades to rotate within the shroud and to allow the pitch of the blades to be adjusted without the creation of unwanted gaps between the blade tip and the inner wall of the shroud.

10. The impeller of claim 1, wherein the impeller rotates within a shroud which has an at least partially spherical inner wall, the blades each having a curved tip which are shaped to allow the pitch of the blades to be adjusted without creation of unwanted gaps between the blade tips and the inner wall of the shroud.

* * * * *